US005601337A

United States Patent [19]

Choda et al.

[11] Patent Number: 5,601,337

[45] Date of Patent: Feb. 11, 1997

[54] CHAIR

[75] Inventors: Mitsunobu Choda; Hideo Nishimura; Atsuo Okamoto, all of Kamakura; Shigeo Negishi, Anjo, all of Japan

[73] Assignees: Uchida Yoko Co., Ltd., Tokyo-to; Meiko Industry Co., Ltd., Aichi-ken, both of Japan

[21] Appl. No.: 278,259

[22] Filed: Jul. 21, 1994

[30] Foreign Application Priority Data

Jul. 27, 1993 [JP] Japan ..... 5-040867 U

[51] Int. Cl.[6] ..... A47C 3/00

[52] U.S. Cl. ..... 297/302.1; 297/300.2

[58] Field of Search ..... 297/300.2, 300.4, 297/300.5, 302.1, 302.3, 302.4, 303.1

[56] References Cited

U.S. PATENT DOCUMENTS

| | | | |
|---|---|---|---|
| 2,447,601 | 8/1948 | Sengpiel | 297/300.5 |
| 3,417,956 | 12/1968 | Helms | 297/302.4 X |
| 5,033,791 | 7/1991 | Locher | 297/302.3 |
| 5,348,371 | 9/1994 | Miotto | 297/300.4 X |

FOREIGN PATENT DOCUMENTS

| | | | |
|---|---|---|---|
| 2001097 | 9/1971 | Germany | 297/301 |
| 3724582 | 2/1989 | Germany . | |
| 9104854 | 6/1991 | Germany . | |

*Primary Examiner*—Laurie K. Cranmer

*Attorney, Agent, or Firm*— Beveridge, DeGrandi, Weilacher & Young, LLP

[57] ABSTRACT

The present device relates to a chair in which a base member is fitted onto an upper portion of a leg comprising a plurality of castors in contact with a floor together with support members for these castors, and a seat portion and a back rest are provided on an upper portion of a support plate that is capable of reclining with respect to the base member. This chair is also provided with a cam-shaped link capable of rotating about the periphery of a pin provided in the base member, an upper portion of the link protrudes towards the support plate side, and a corresponding elastic member that is compressed by the rotation of the link is provided in a bottom portion of the base member. A shaft portion in contact with the link, and which causes the link to change profile in response to the reclining action, is provided within the support plate. This configuration provides a chair that is inexpensive and can naturally adopt either a serious working position or a relaxed reclining position.

20 Claims, 7 Drawing Sheets

CHAIR

BACKGROUND OF THE INVENTION

The present invention relates to an office chair and, in particular, to a chair that can naturally adopt either of two positions, a serious working position and a relaxed reclining position, when a person is seated upon it.

The typical office chair that has long been used is provided with a gas spring and a coil spring as attached energy means on the underside of a seat thereof, and the configuration is such that large inclinations of a back rest are implemented by the gas spring whereas small adjustments of the inclination of the back rest in the final stages are implemented by the coil spring.

However, since a gas spring is used as the reclining mechanism for the seat, the manufacturing costs are inevitably high, and thus it is extremely difficult in the prior art to provide an inexpensive chair, despite all efforts to reduce the costs of other components.

In addition, since adjustment of the seat back reactive force in the prior art makes use of a spring such as a coil spring with a single type of spring characteristic, it is difficult to implement a natural reclining state. In other words, the fault occurs that, just by the person sitting, the seat portion and back rest of the chair recline backwards, making it difficult to achieve a working position, on the other hand, if the reactive force of the coil spring is made stronger, this makes it difficult to recline backwards, and in that state reclining becomes so difficult it is not possible to relax.

SUMMARY OF THE INVENTION

The present invention was devised in the light of the above described problems and has as an objective the provision of a chair that is inexpensive and has a structure such that it can naturally adopt either a serious working position or a relaxed reclining position, and which is designed to remove the defects of the prior art.

In order to achieve the above objective, the present invention concerns a chair in which a base member is fitted onto an upper portion of a leg comprising a plurality of castors in contact with a floor together with support members for these castors, and a seat portion and a back rest are provided on an upper portion of a support plate attached to the base member so as to be is capable of reclining with respect thereto. In accordance with this invention, this chair is also provided with a cam-shaped link capable of rotating about the periphery of a pin provided in the base member, an upper portion of the link protrudes towards the support plate side, and a corresponding elastic member that is compressed by the rotation of the link is provided in a bottom portion of the base member. A shaft portion in contact with the link, and which causes the link to change profile in response to the reclining action of the support plate, is provided within the support plate. A stopper lever is also provided in the base member to maintain the upright state of the link.

With the above described configuration, the inclination of the base member causes the shaft portion to compress the link of the base member that it is in contact with, and thus a cushion state can be maintained. Operation of the stopper lever holds the link in its upright state, and thus the inclination of the seat portion and back rest of the chair can be locked in a simple manner.

DESCRIPTION OF THE PREFERRED EMBODIMENT

An embodiment of the present invention will be described below with reference to the accompanying drawings.

Figure 1:
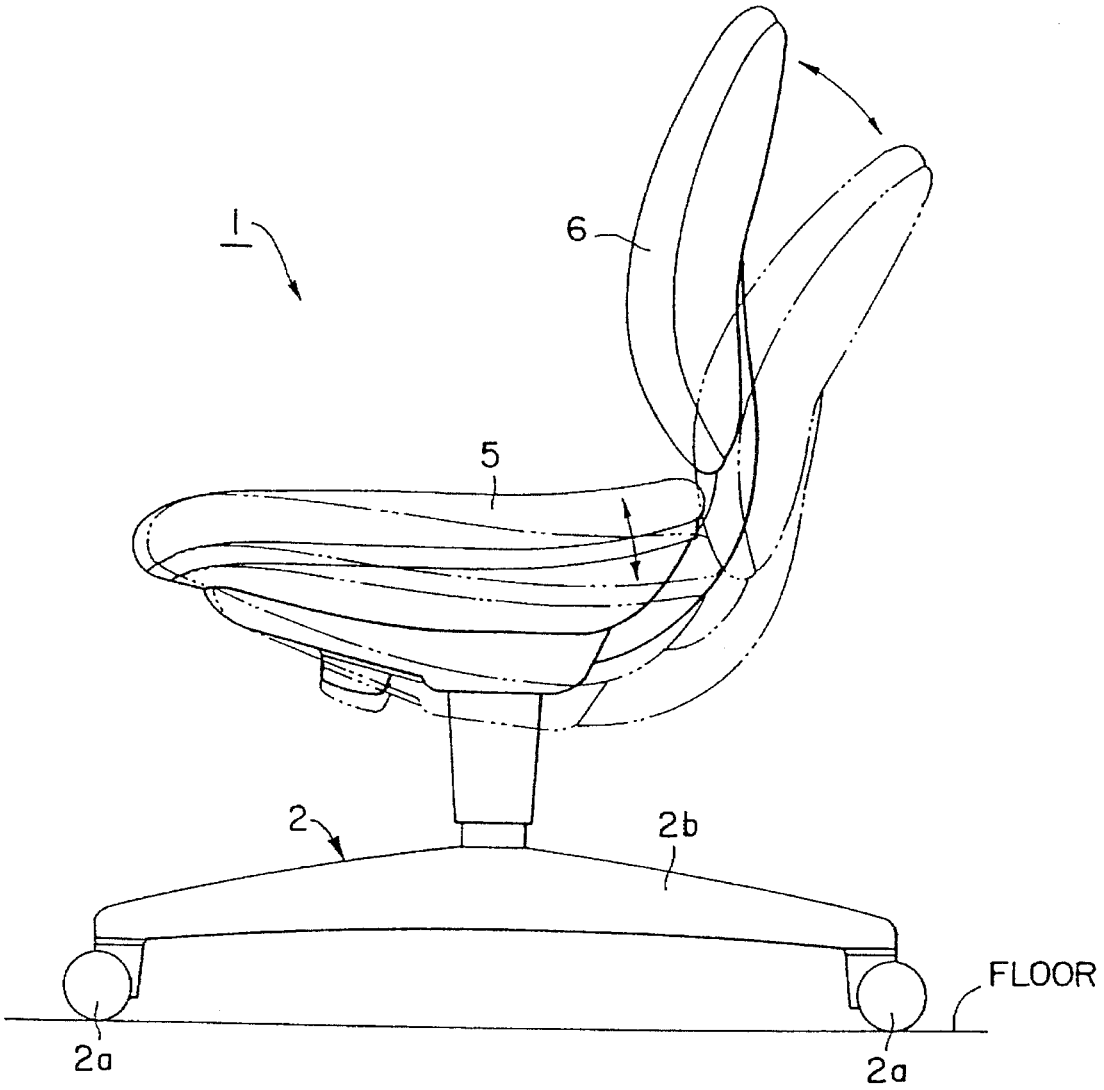
FIG. 1 is a side view of the exterior of an embodiment of a chair in accordance with the present invention.
Figure 2:
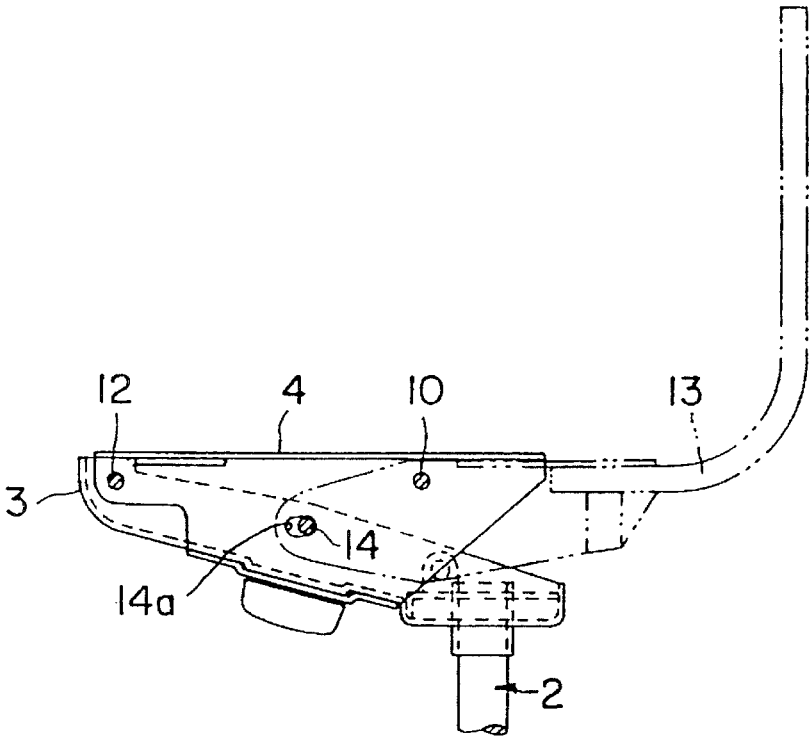
FIG. 2 is a side view of a frame portion of the chair shown in FIG. 1.

In a chair 1 of the present invention, shown in FIG. 1 and FIG. 2, a base member 3 is fitted onto an upper portion of a leg 2 comprising a plurality of radially arranged castors 2*a* in contact with a floor together with support members 2*b* for these castors 2*a*, and a seat portion 5 and a back rest 6 are provided on a support plate 4 that is capable of reclining with respect to the base member 3.

Figure 4:
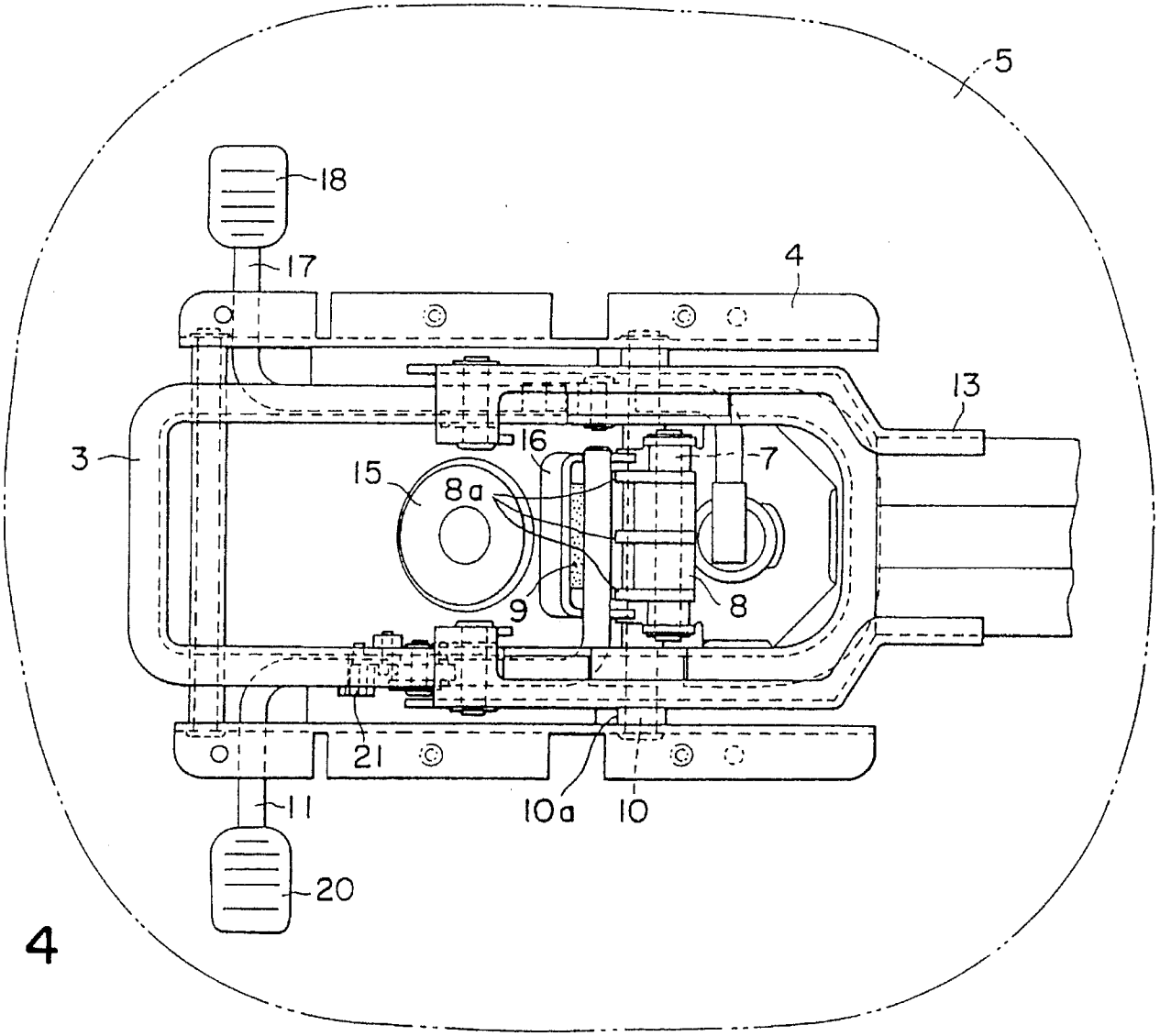
FIG. 4 is a plan view of the frame portion of FIG. 2.
Figure 5:
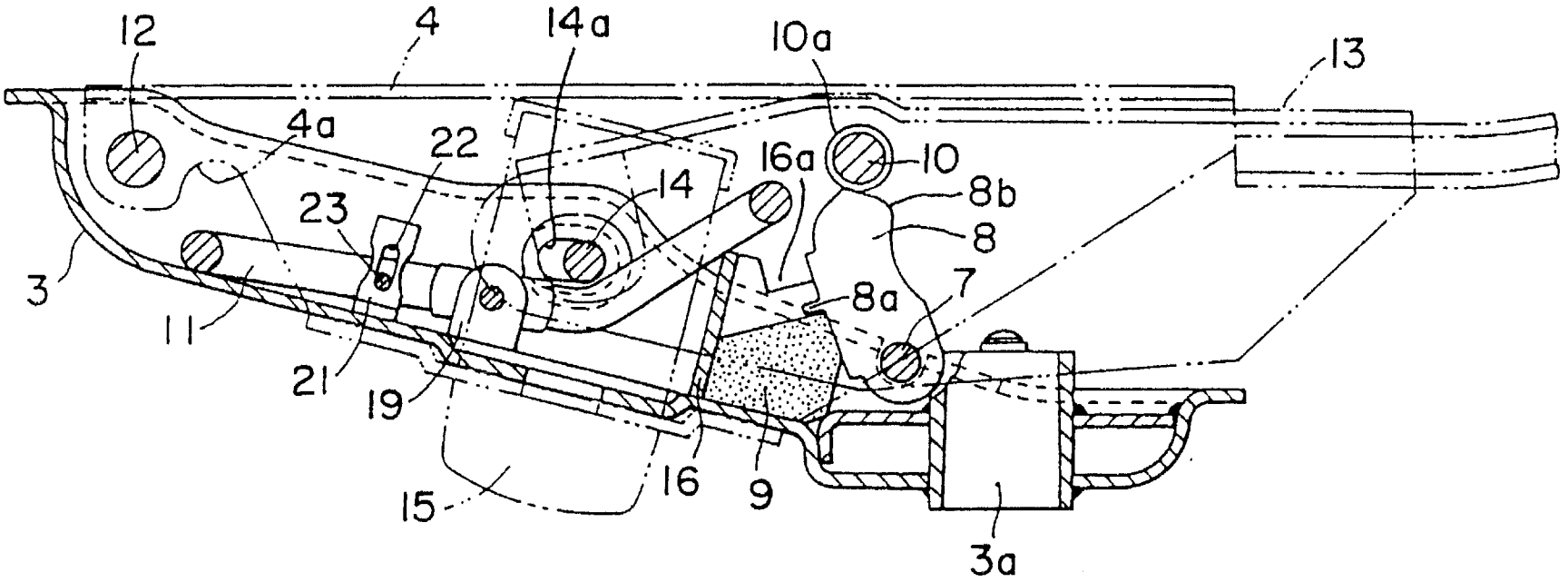
FIG. 5 is a side view of an embodiment of vital components of the chair in accordance with the present invention.

As shown in FIG. 4 and FIG. 5, the configuration is such that a cam-shaped link 8 wherein its back surface has a cam-shaped surface 8*b* is rotatably attached around the periphery of a pin 7 that is provided in the base member 3, an upper portion of the link protrudes towards the support plate 4 side, and a corresponding elastic member 9 that is compressed by the rotation of the link 8 is provided in a bottom portion of the base member 3. A shaft portion 10 in contact with the link 8, and which causes the link 8 to change profile in response to the reclining action of the support plate 4, is provided within the support plate 4. A stopper lever 11 is also provided in the base member 3 to maintain the upright state of the link 8.

Figure 3:
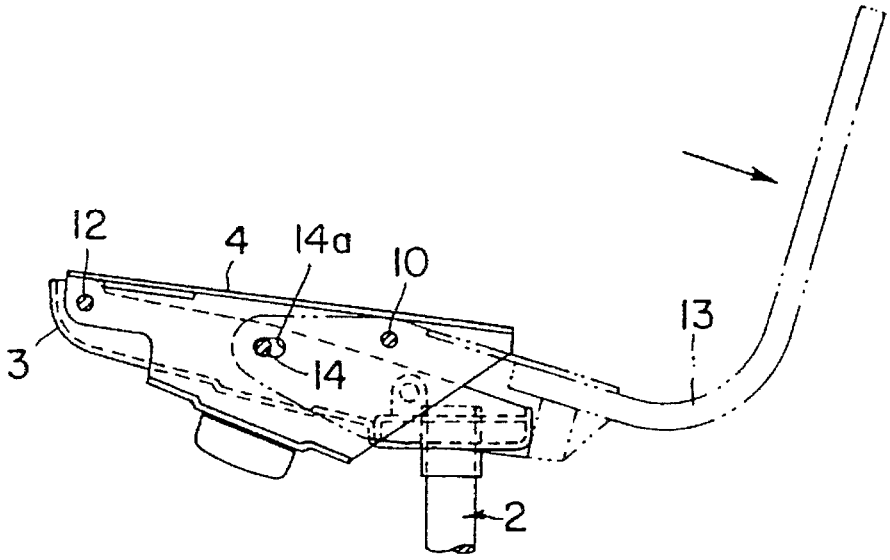
FIG. 3 is a side view of the frame portion of FIG. 2 when it is in reclined state.

The seat portion 5 and back rest 6 of the chair 1 of the present invention are designed to able to recline backwards from a solid-line position to a dotted line position shown in FIG. 1, in the same manner as a prior art chair. The frame structure of this chair is such that the support plate 4 of the upper portion thereof rotates with respect to the base member 3 about a pivot of a pin 12 affixed to a front portion of the chair, as shown in FIG. 2 and FIG. 3, the back frame 13 rotates about a pivot of the shaft portion 10 provided in the support plate 4, and the base member 3 and back frame 13 are further linked together by a pin 14 that passes through an elongated hole.

A plan view of the structure of FIG. 2 is shown in FIG. 4, and a detailed side view thereof is shown in FIG. 5, illustrating that the base member 3 is within the support plate 4, and the back frame 13 is provided in a rear portion of the base member 3. A coil spring 15, the link 8 that is a vital component of the present invention, the elastic member 9 formed of a material such as polyurethane rubber, and a cushion receptacle 16 that holds the elastic member 9 are provided within the base member 3, and a collar 10*a* is provided straddling over the shaft portion 10 between the wall surfaces of the support plate 4. Reference number 3*a* denotes a hole for inserting the leg 2. As shown in FIG. 5, the stopper lever 11 is provided in a lower portion (on the front left side) of the assembly. In an upper portion (on the front right side) thereof, there is a lever 17 for raising and lowering the chair 1, with a lever cap 18 for raising and lowering the seat portion being provided at a leading end thereof.

The cam-shaped surface 8*b* of the link 8 is ordinarily placed in contact with the collar 10*a* attached to the shaft portion 10, there are projections 8*a* in the front side thereof at the center and at each end, the pin 7 is inserted into a lower portion thereof, and the upper portion thereof rotates about the pin 7. This ensures that, when the back rest is inclined forward, the projections 8*a* first come into contact with the elastic member 9 made of a material such as polyurethane rubber and then compress it.

Figure 8:
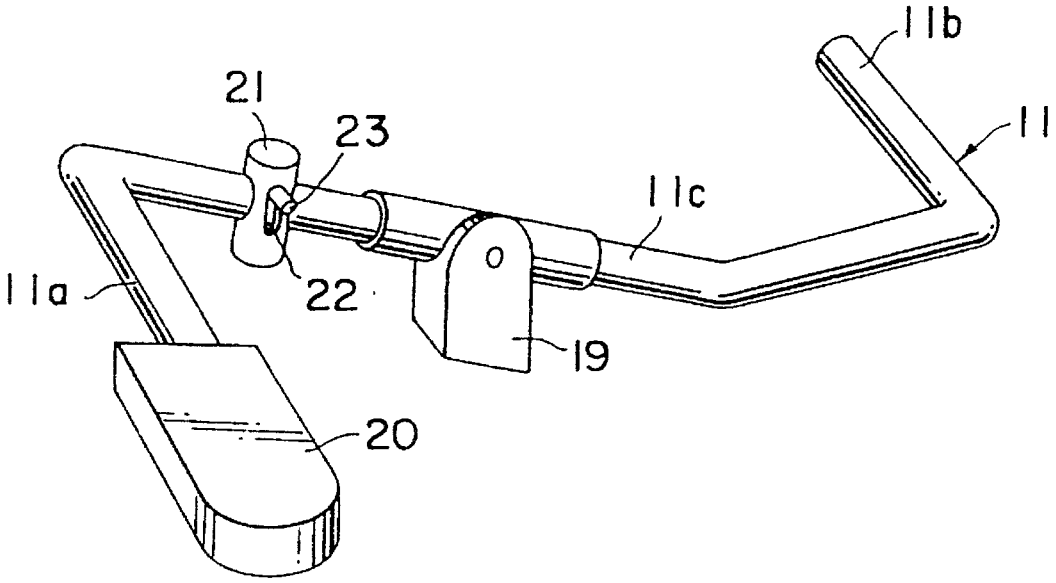
FIG. 8 is a perspective view of the stopper lever.

The stopper lever 11 of the chair in accordance with the present invention, shown in perspective in FIG. 8, has a shape such that two end portions 11*a* and 11*b* thereof are bent into mutually opposite directions with respect to a central portion 11*c* thereof, the central portion 11*c* is supported on a stopper lever stay 19 provided in a base portion of the base member 3 in such a manner that the entire lever can rotate upward or downward. The end portion 11*a* on the outer side is provided with a handle 20. A V-shaped notch 16*a* is provided in an upper portion of the 10 cushion receptacle 16. When the end portion 11*b* at the inner side of the stopper lever 11 rotates and enters the notch 16*a*, it comes into contact with the link 8 in such a manner that it releases the forward inclination. In FIG. 5, reference number 4*a* denotes a cutout for preventing the stopper lever 11 from moving upward, reference number 21 denotes a slide guide, and reference number 22 denotes an elongated hole into which a peg 23 provided on the stopper lever 11 is inserted so that it can move either up or down, for fixing the stopper lever 11 in position.

The operation of the chair in accordance with the present invention will now be described.

When a person sits on the seat portion 5 with the chair in the state shown in FIG. 5, the support plate 4 reclines backward with respect to the base member 3. This causes the collar 10*a* that is ordinarily in contact with the cam-shaped surface 8*b* of the link 8 to be pushed down while sliding over the outer periphery of the link 8, so that the link 8 compresses the forward-inclined elastic member 9 and reaches the state shown in FIG. 6. Thus the chair 1 receives a reactive force not only from the coil spring 15 but also from the elastic member 9, and can thus take up a more natural reclining position.

Figure 6:
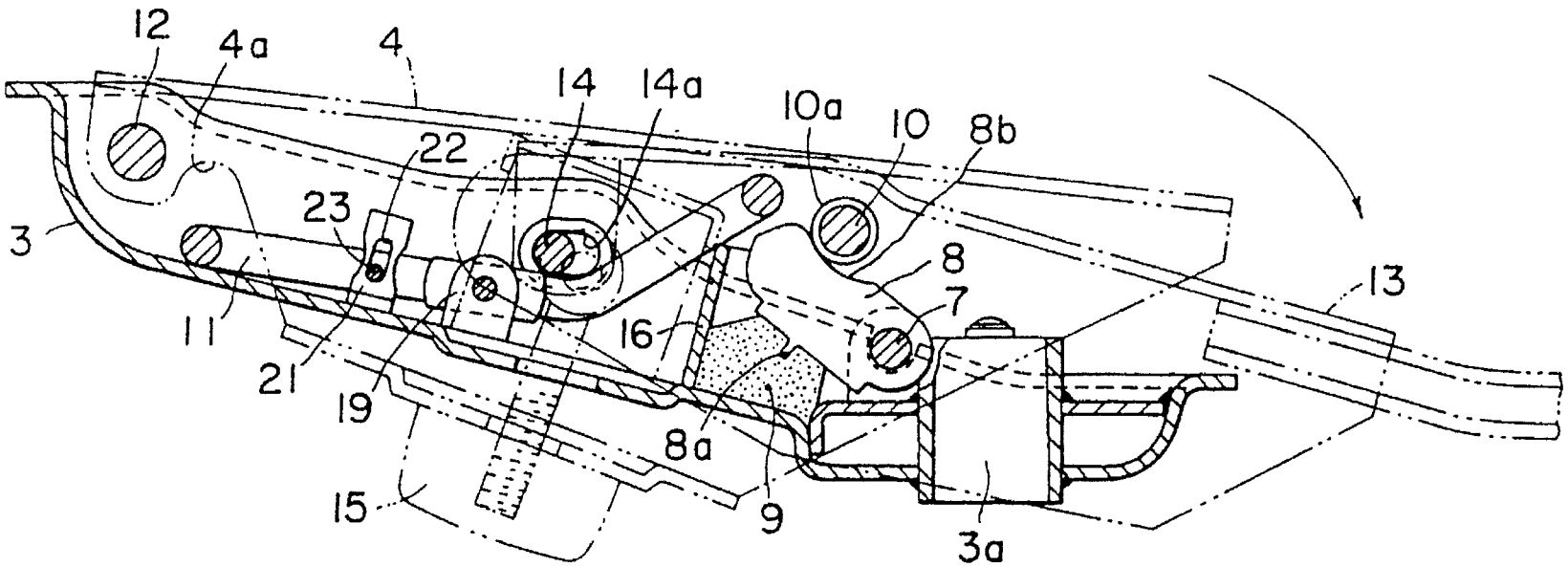
FIG. 6 is a side view of the vital chair components of FIG. 5 when in an inclined state.
Figure 7:
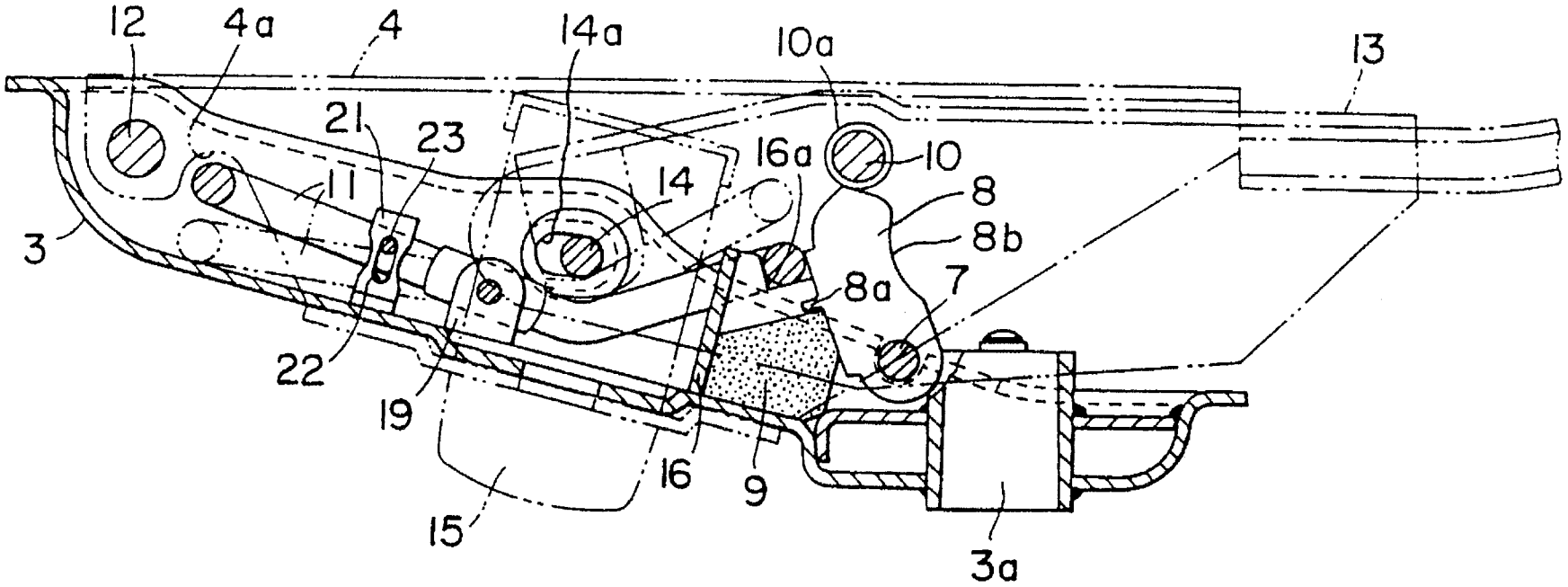
FIG. 7 is a side view of the vital chair components of FIG. 5 in a state when they are locked by a stopper lever.

Next, to change the reclining position shown in FIG. 6 to a working position, the user returns the back portion to its foremost inclined position (the state shown in FIG. 5), then operates the end portion 11*a* of the stopper lever 11 having the handle 20 in the upward direction, as shown by the arrow, so that the other end portion 11*b* enters the notch 16*a* of the cushion receptacle 16. Thus the stopper lever 11 stops the rotation of the link 8, even if the link 8 has been inclined forward by the person sitting down on the seat portion 5. The backward inclination of the seat portion 5 and back rest 6 of the chair 1 is locked. Then the stopper lever 11 is fixed at the upper side of the elongated hole 22. To release the lock, the user can operate the stopper lever 11 in the downward direction.

As described above, in the chair in accordance with the present invention, a base member is fitted onto an upper portion of a leg comprising a plurality of radially arranged castors in contact with a floor together with support members for these castors, and a seat portion and a back rest are provided on an upper portion of a support plate that is capable of reclining with respect to the base member. The chair is also provided with a cam-shaped link capable of rotating about the periphery of a pin provided in the base member, an upper portion of the link protrudes towards the support plate side, and a corresponding elastic member that is compressed by the rotation of the link is provided in a bottom portion of the base member. The provision within the support plate of a shaft portion in contact with the link, and which causes the link to change profile in response to the reclining action of the support plate, ensures that the shape of the link can be selected and fabricated as appropriate and the reactive force of the chair can be set to any required level by compression of the elastic member 9 formed of a material such as polyurethane rubber. Therefore, the weight of the user can be supported in a natural manner throughout the entire use of the chair. Since the movement of the link can be stopped by a simple mechanism, the chair's position while the user is working can be maintained, and the working position can be locked.

What is claimed is:

1. A chair in which a base member is fitted onto an upper portion of a leg assembly in contact with a floor, and a seat portion and a back rest are provided on an upper portion of a support plate which is capable of reclining with respect to said base member, said chair comprising:

a cam-shaped link which is rotatable about a pin provided in said base member;

an upper portion of said link protruding towards said support plate;

an elastic member made of rubber which is compressed directly by said link upon rotation of said link and which is provided in a bottom portion of said base member; and a shaft portion in contact with said link, and which causes said link to change in rotational position in response to the reclining action of said support plate.

2. The chair of claim 1, further comprising a stopper lever for maintaining said link in an upright state within said base member.

3. The chair of claim 2, wherein said stopper lever has a shape in which two end portions thereof are bent in mutually opposite directions with respect to a central portion thereof, and one of said end portions is provided with a handle.

4. The chair of claim 2, further comprising a receptacle for the elastic member which is provided adjacent to said elastic member and facing said elastic member, wherein a notch is formed in an upper portion of said receptacle and, when said stopper lever rotates in such a manner that the inner end portion thereof enters said notch, said stopper lever comes into contact with said link and prevents the forward inclination thereof.

5. The chair of claim 1, wherein projections are provided at a central portion and end portions of a front side of said link, in such a manner that said projections come into contact with and compress said elastic member when said back rest is inclined rearwardly.

6. The chair of claim 1 wherein said leg assembly includes castors as well as a leg having a plurality of leg extensions which receive said castors.

7. The chair of claim 1 wherein said cam-shaped link includes a curved surface upon which said shaft rides.

8. A chair in which a base member is fitted onto an upper portion of a leg assembly in contact with a floor, and a seat portion and a back rest are provided on an upper portion of a support plate which is capable of reclining with respect to said base member, said chair comprising:

a cam-shaped link which is rotatable about a pin provided in said base member;

an upper portion of said link protruding towards said support plate;

an elastic member made of rubber which is compressed by the rotation of said link and which is provided in a bottom portion of said base member;

a shaft portion in contact with said link, and which causes said link to change in rotational position in response to the reclining action of said support plate; and further comprising a coil spring having a first end supported by said base member and an upper end positioned for biasing said seat portion.

9. A chair, comprising:

a leg assembly having a first end for contact with a floor support surface and an upper end;

a base member supported on the upper end of said leg assembly;

a support plate pivotably supported with respect to said base member;

a seat portion and a back rest supported by said support plate;

a cam-shaped link pivotably supported by said base member, said link having an upper portion protruding toward said support plate;

an elastomeric cushion which is supported by said base member and is compressed directly by said link upon rotation of said link in a first direction; and a shaft portion supported by said support plate and in contact with said link which is positioned so as to cause said link to rotate in the first direction and to compress said elastomeric cushion when said back rest is placed in a reclining position.

10. A chair as recited in claim 9 wherein said elastomeric cushion is formed of a polyurethane material.

11. A chair as recited in claim 9 wherein said elastomeric cushion is formed of a rubber material.

12. A chair as recited in claim 9 further comprising a stopper lever which is pivotably supported by said base member and which includes a first grasping end and a second end, and said stopper lever, upon rotation, contacts said cam-shaped link to preclude rotation thereof in the first direction.

13. A chair as recited in claim 12 further comprising a receptacle for said elastomeric cushion which is supported by said base member, said receptacle having an open end to allow rotation of said link into compressive contact with said elastomeric cushion, and said receptacle having a notch formed in an edge defining the open end of the receptacle which is dimensioned for receipt of the second end of said stopper lever.

14. The chair of claim 9 wherein projections are provided at a central portion and end portions of a front side of said link in such a manner that said projections come into contact with and compress said elastomeric cushion when said back rest is inclined rearwardly.

15. A chair as recited in claim 9 wherein said leg assembly includes castors as well as a plurality of leg extensions which receive said castors.

16. A chair as recited in claim 9 wherein said cam-shaped link has a curved surface upon which said shaft rides.

17. A chair, comprising:

a leg assembly having a first end for contact with a floor support surface and an upper end;

a base member supported on the upper end of said leg assembly;

a support plate pivotably supported with respect to said base member;

a seat portion and a back rest supported by said support plate;

a cam-shaped link pivotably supported by said base member, said link having an upper portion protruding toward said support plate;

an elastomeric cushion which is supported by said base member and is compressed by said link upon rotation of said link in a first direction;

a shaft portion supported by said support plate and in contact with said link which is positioned so as to cause said link to rotate in the first direction and to compress said elastomeric cushion when said back rest is placed in a reclining position; and wherein said support plate rotates with respect to said base member about a first pivot pin affixed to a front end of said base member and said back rest includes a back frame that is rotatably secured about a second pivot pin secured to said support plate, and said back rest is also rotatably secured about a third pivot pin secured to said base member which is forward of said second pivot pin and rearward of said first pivot pin.

18. A chair as recited in claim 17 wherein said third pivot pin is received in an elongated hole formed in said base member.

19. A chair, comprising:

a leg assembly having a first end for contact with a floor support surface and an upper end;

a base member supported on the upper end of said leg assembly;

a support plate pivotably supported with respect to said base member;

a seat portion and a back rest supported by said support plate;

a cam-shaped link pivotably supported by said base member, said link having an upper portion protruding toward said support plate:

an elastomeric cushion which is supported by said base member and is compressed by said link upon rotation of said link in a first direction;

a shaft portion supported by said support plate and in contact with said link which is positioned so as to cause said link to rotate in the first direction and to compress said elastomeric cushion when said back rest is placed in a reclining position; and further comprising a coil spring having a first end supported by said base member and a second end positioned for biasing said seat portion.

20. A chair in which a base member is fitted onto an upper portion of a leg which comprises a plurality of castors in contact with a floor and which supports said castors, and a seat portion and a back rest are provided on an upper portion of a support plate which is capable of reclining with respect to said base member, said chair comprising:

a cam-shaped link capable of rotating about the periphery of a pin provided in said base member;

an upper portion of said link protruding towards said support plate;

an elastic member which is compressed by the rotation of said link and which is provided in a bottom portion of said base member; and a shaft portion in contact with said link, and which causes said link to change rotational position in response to the reclining action of said support plate;

a stopper lever for maintaining said link in an upright state within said base member; and a receptacle which receives said elastic member and faces said elastic member, wherein a V-shaped notch is formed in an upper portion of said receptacle and, when said stopper lever rotates in such a manner that the inner end portion thereof enters said notch, said stopper lever comes into contact with said link arid prevents forward rotation thereof.

* * * * *